US011313143B2

(12) United States Patent
Huang et al.

(10) Patent No.: US 11,313,143 B2
(45) Date of Patent: Apr. 26, 2022

(54) WATER SPRAYING DEVICE AND POOL

(71) Applicant: BESTWAY INFLATABLES & MATERIAL CORP., Shanghai (CN)

(72) Inventors: Shuiyong Huang, Shanghai (CN); Xinwei Chen, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 78 days.

(21) Appl. No.: 16/854,472

(22) Filed: Apr. 21, 2020

(65) Prior Publication Data

US 2020/0370321 A1 Nov. 26, 2020

(30) Foreign Application Priority Data

May 22, 2019 (CN) ..... 201920739440.7

(51) Int. Cl.
*E04H 4/16* (2006.01)
*E04H 4/12* (2006.01)
*E04H 4/00* (2006.01)

(52) U.S. Cl.
CPC ..... *E04H 4/169* (2013.01); *E04H 4/1245* (2013.01); *E04H 4/0025* (2013.01)

(58) Field of Classification Search
CPC ..... E04H 4/169
USPC ..... 4/507, 506, 508, 509, 494
See application file for complete search history.

(56) References Cited

U.S. PATENT DOCUMENTS 4,939,797 A 7/1990 Goettl
5,115,974 A 5/1992 Tobias et al.

OTHER PUBLICATIONS

Extended European Search Report dated Oct. 30, 2020 (Oct. 30, 2020) issued on related European patent application 20173417.5 by the European Patent Office.
Extended European Search Report dated Feb. 4, 2021 (Feb. 4, 2021) issued on related European patent application 20173417.5 by the European Patent Office.

*Primary Examiner* — Lori L Baker
(74) *Attorney, Agent, or Firm* — Dickinson Wright PLLC

(57) ABSTRACT

A water spraying device is provided, the device including a water spraying body configured to be fixed to a pool above a water level. The water spraying body includes a first housing with a support seat, and a second housing including a rotating shaft supported by the support seat so the second housing is rotatable relative to the first housing. The water spraying body also includes a spray head in the second housing and configured to discharge water into the pool.

18 Claims, 21 Drawing Sheets

WATER SPRAYING DEVICE AND POOL

CROSS REFERENCE TO RELATED APPLICATIONS

This utility patent application claims the benefit and priority of Chinese patent application CN 201920739440.7, filed May 22, 2019, the full content of which is herein incorporated by reference.

TECHNICAL FIELD

The present disclosure relates to the technical field of water spraying. More specifically, the present disclosure relates to a water spraying device and a pool including a water spraying device.

BACKGROUND

Conventional water spraying devices, such as faucets or water pipes, may have a relatively simple structure that may have a number of drawbacks, such as limited ability to create and direct a water spray pattern to satisfy people's entertainment demands. Conventional water spraying devices may have an unattractive or utilitarian appearance. Also, conventional water spraying devices may not be easily connected to pool.

In order to relieve people's life and work pressure and enhance their entertainment and interest with the pool, in some existing solutions, some water spraying devices of a simple structure are used, in which the water spraying device is fixed to a pool, and water is supplied to the water spraying device via a pipeline for spraying water into the pool. However, such water spraying devices are typically rigidly fixed to the pool, resulting in undesirable operation. Moreover, mounting structures for such conventional water spraying devices are relatively complicated, and replacement or repair of conventional water spraying devices is relatively time-consuming and labor-intensive.

SUMMARY

In accordance with various embodiments of the present disclosure, a water spraying device for a provided pool comprises a water spraying body configured to be fixed to the provided pool above a water level in the provided pool. The water spraying body includes a first housing with a support seat disposed inside the first housing, and a second housing including a rotating shaft supported by the support seat such that the second housing is rotatable relative to the first housing. The water spraying body also includes a spray head located in the second housing and configured to discharge water into the provided pool.

In accordance with various embodiments of the present disclosure a water spraying device for a provided pool comprises a base configured to be fixed to the provided pool above a water level in the provided pool, the base including a side wall having a cylindrical shape with a baffle located on an inner surface of the side wall and extending circumferentially therefrom. The water spraying device also comprises a water spraying body including a casing and a spray head located at a top of the casing and configured to discharge water into the provided pool, the water spraying body having an abutment portion extending circumferentially around a bottom of the casing. The abutment portion is adapted to abut against a bottom face of the baffle.

BRIEF DESCRIPTION OF THE DRAWINGS

To understand the present disclosure, it will now be described by way of example, with reference to the accompanying drawings in which implementations of the disclosure are illustrated and, together with the description below, serve to explain the principles of the disclosure.

DETAILED DESCRIPTION

The present disclosure provides exemplary embodiments of a water spraying device, and a pool fitted with such a water spraying device. The exemplary embodiments of the present disclosure are described below with reference to the drawings for illustration. It should be understood that the specific embodiments discussed only illustratively describe specific implementations and uses of the present disclosure, but are not intended to limit the scope of the present disclosure. During description, the structural positions of various components, e.g., upper, lower, top, bottom, etc., are not absolute, but relative. The orientation expressions are appropriate when the various components are arranged as shown in the figures, but should change accordingly when the positions of the various components in the figures change. In this Description, the terms "upper", "lower", "left", "right", etc. are used for the convenience of description, and are not restrictive.

The water spraying device and the pool of the present disclosure provide at least the following advantages: (1) the exemplary water spraying device provides an adjustable water discharge angle while in use; (2) the exemplary water spraying device can be conveniently and easily installed and detached from a pool, saving on time and labor for replacement, maintenance and other operations; and (3) the exemplary water spraying device provides a water stream into the pool that is precise and adjustable, thereby improving the entertainment value of the pool. The above and other advantages and features will become apparent from the following detailed description of the exemplary embodiments in conjunction with the accompanying drawings.

Figure 1:
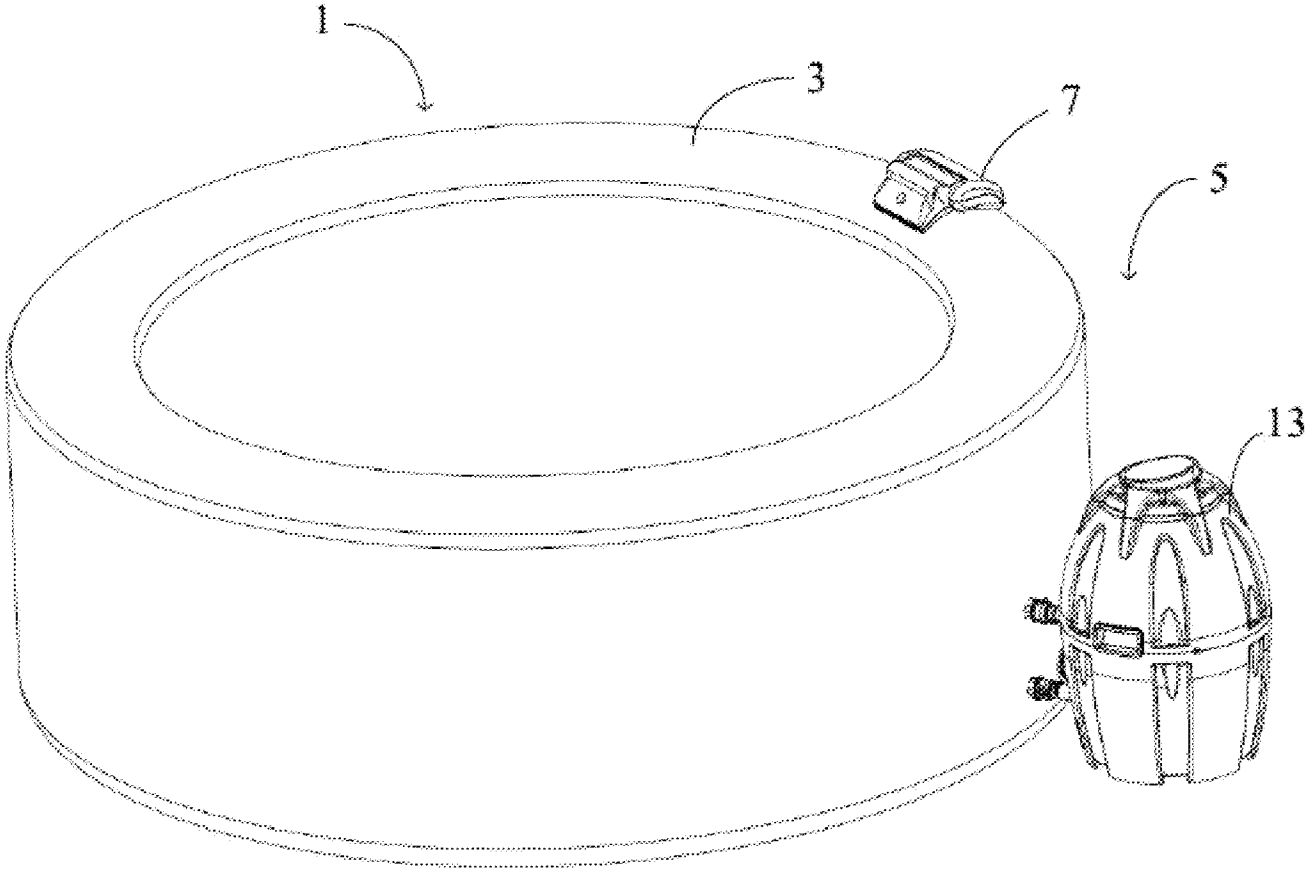
FIG. 1 is a perspective view of a pool according to some embodiments of the present disclosure.
Figure 2:
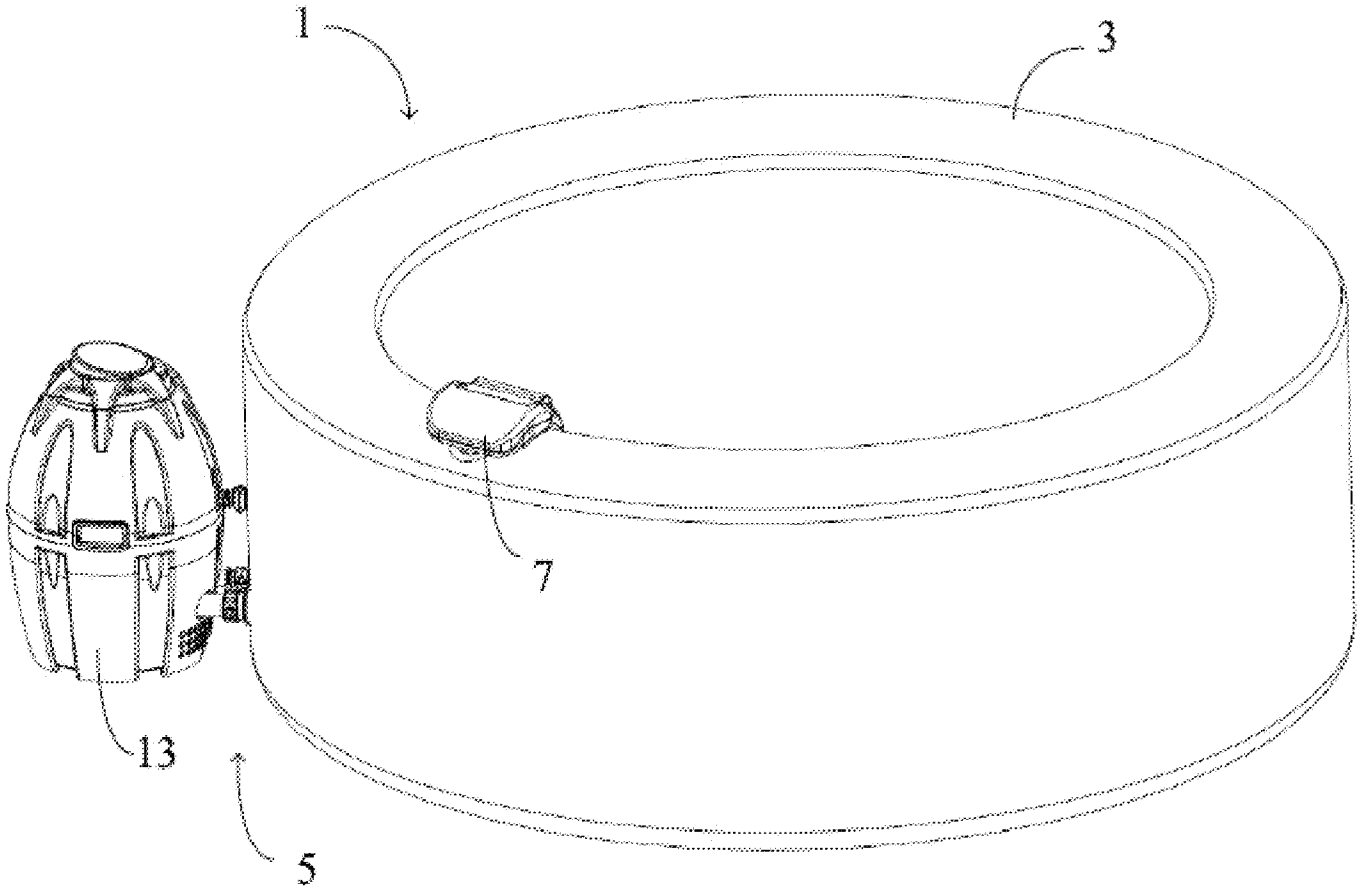
FIG. 2 is a perspective view of the pool according to some embodiments of the present disclosure.
Figure 3:
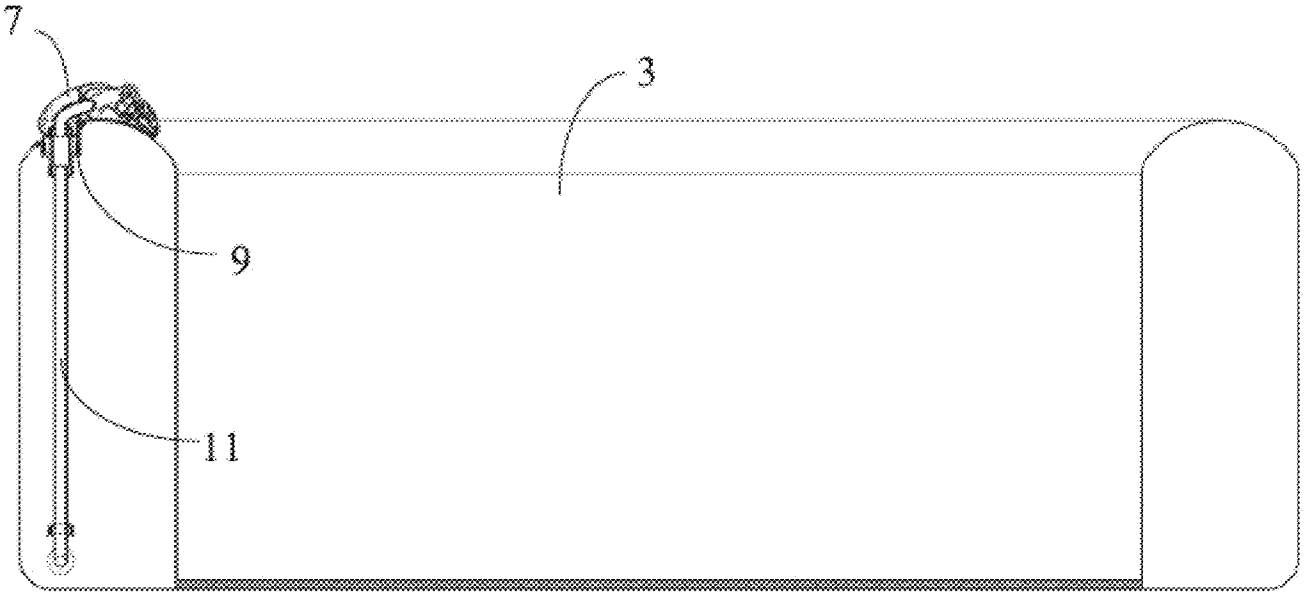
FIG. 3 is a cross-sectional view of the pool according to some embodiments of the present disclosure, with an exemplary water spraying device being mounted to a pool body.
Figure 4:
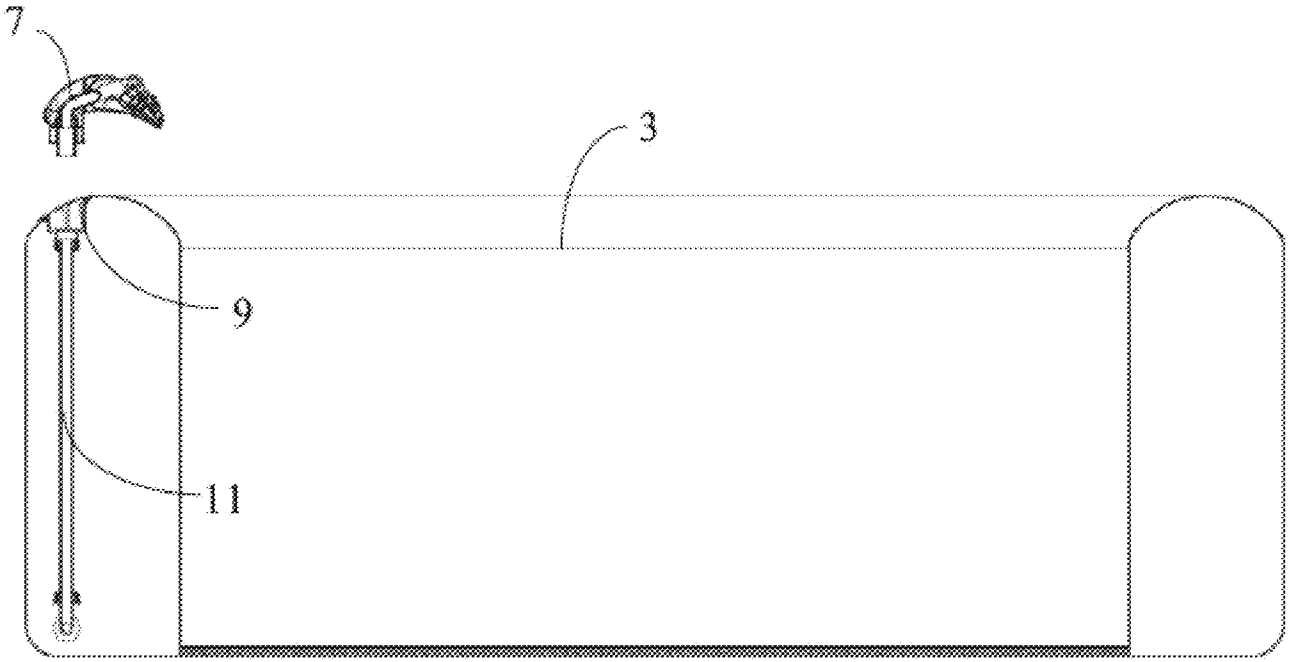
FIG. 4 is a cross-sectional view of the pool according to some embodiments of the present disclosure, with the exemplary water spraying device separated from the pool body.
Figure 5:
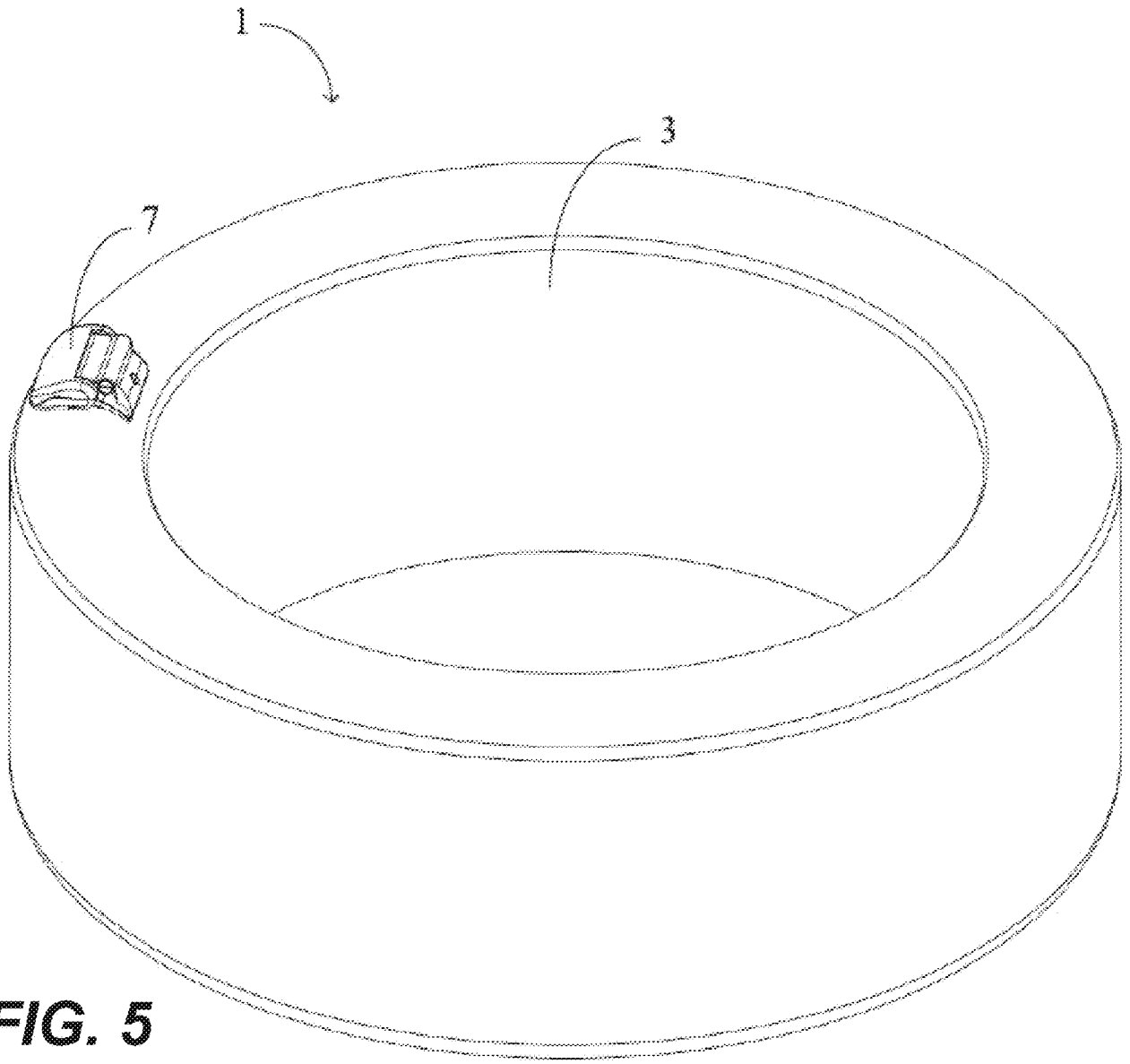
FIG. 5 is a perspective view of the pool according to some embodiments of the present disclosure, with an exemplary water spraying body in a lowered position.
Figure 6:
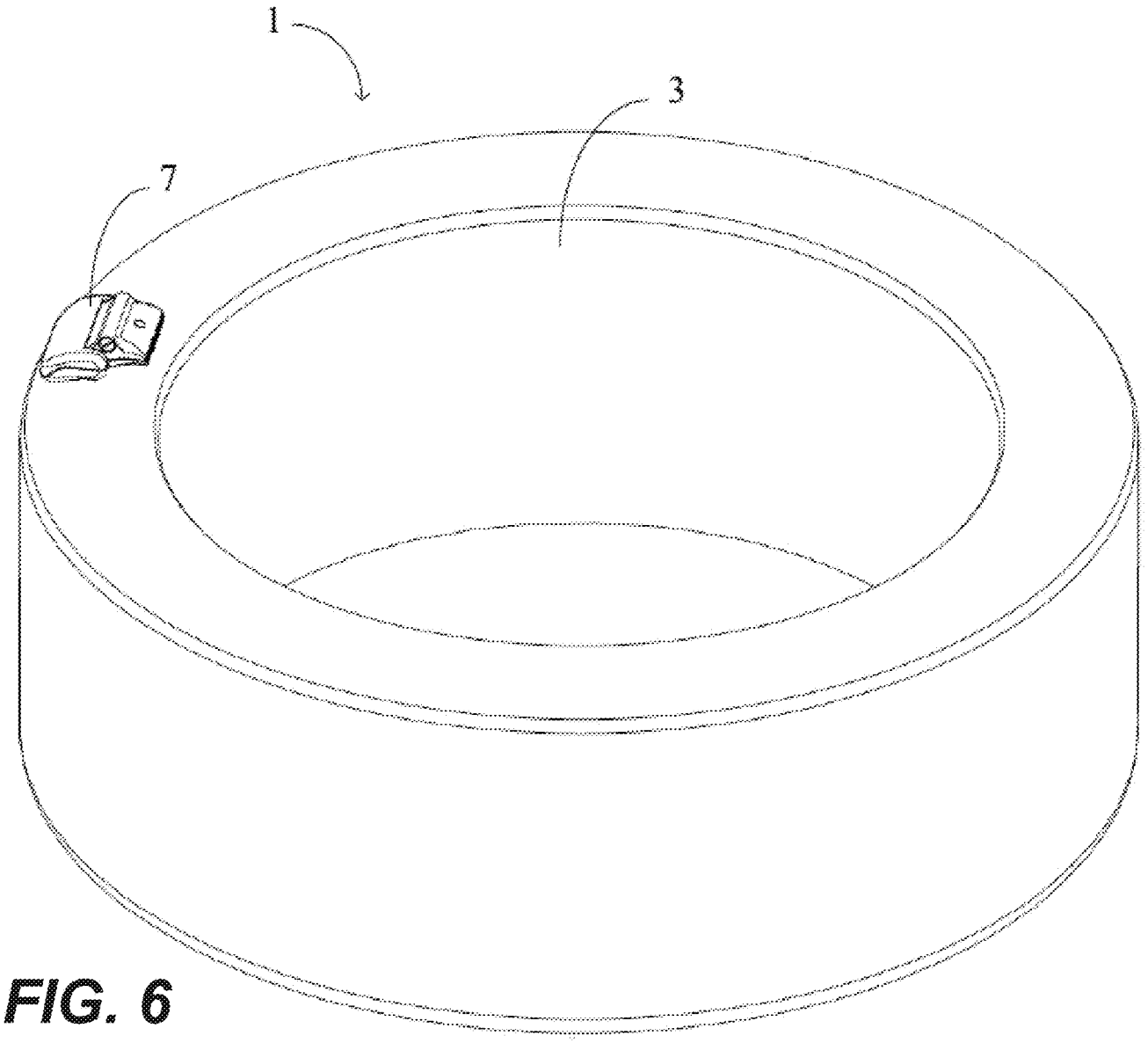
FIG. 6 is a perspective view of the pool according to some embodiments of the present disclosure, with the exemplary water spraying body in a raised position.

FIGS. 1 to 6 show various views of a pool according to some embodiments of the present disclosure. As shown, the pool 1 includes a pool body 3 and a water spraying device 5 mounted to the pool body 3. The exemplary pool body 3 takes the form of an inflatable pool with a circular shape. However, the water spraying device 5 of the present disclosure may be used with any pool type and with any shape of pool. The water spraying device 5 comprises a water spraying body 7, a base 9, a water pipe 11 and a water pump 13. The water spraying body 7 is configured to be fixed to the pool 1 above a water level in the pool for discharging a stream of water into the pool. FIGS. 1 and 2 show the water spraying body 7 located at the top of a side wall of the pool body 3, and the water pump 13 located outside of the pool body 3. As shown in FIGS. 3 and 4, the water pipe 11 is located inside an inflatable chamber of the side wall of the pool body 3, with one end of the water pipe 11 being connected to the water pump 13 (see FIGS. 1 and 2), and the other end of the water pipe 11 being connected to the base 9. The base 9 is mounted at the top of the side wall of the pool body 3, and the water spraying body 7 is mounted to the base 9. The water spraying body 7 can be easily detached from the base 9. In operation, the water pump 13 pumps water contained by the pool body 3 through the water pipe 11, and into the water spraying body 7. Water is sprayed from the water spraying body 7 into the pool body 3, thereby forming a circulating loop. The water spraying device 5 may also supply water into the pool body 3 by the water spraying body 7 in other ways. For example, the water spraying device 5 may be provided with water from the pool body 3 that first passes through a filter and/or a heater (neither shown). FIGS. 5 and 6 show the water spraying body 7 at lowered and raised angles of water discharge, respectively.

It should be understood that although the present disclosure shows and describes an exemplary application of the water spraying device 5 with the pool body 3, the water spraying device 5 of the present disclosure may also be used for other applications, such as a hot tub, a pond, etc. Moreover, the provided disclosure of the water spraying device 5 including the water spraying body 7, the base 9, the water pipe 11, and the water pump 13 is not restrictive, as the water spraying device 5 may comprise only some of these components or further comprise other components. The water spraying device 5 can use various different arrangements with respect to the pool body 3, without being limited to the arrangements, as shown in the figures.

FIGS. 7 to 16 show various different views of the water spraying device 5 according to some embodiments of the present disclosure. As shown, the water spraying body 7 comprises a first housing 15, a second housing 17 and a spray head 19. The first housing 15 includes a support seat 21 disposed inside of the first housing 15. The second housing 17 includes a rotating shaft 23, and the rotating shaft 23 is supported by the support seat 21 such that the second housing 17 can rotate relative to the first housing 15. The spray head 19 is provided in the second housing 17. In this way, the spray head 19 provided in the second housing 17 can rotate relative to the first housing 15, and therefore, can adjust the angle of water discharge of the water spraying body 7. In the illustrated embodiment, the support seat 21 is an arc recess, and the arc recess and the rotating shaft 23 match each other in shape. Preferably, the shape thereof is a semicircular shape.

Figure 8:
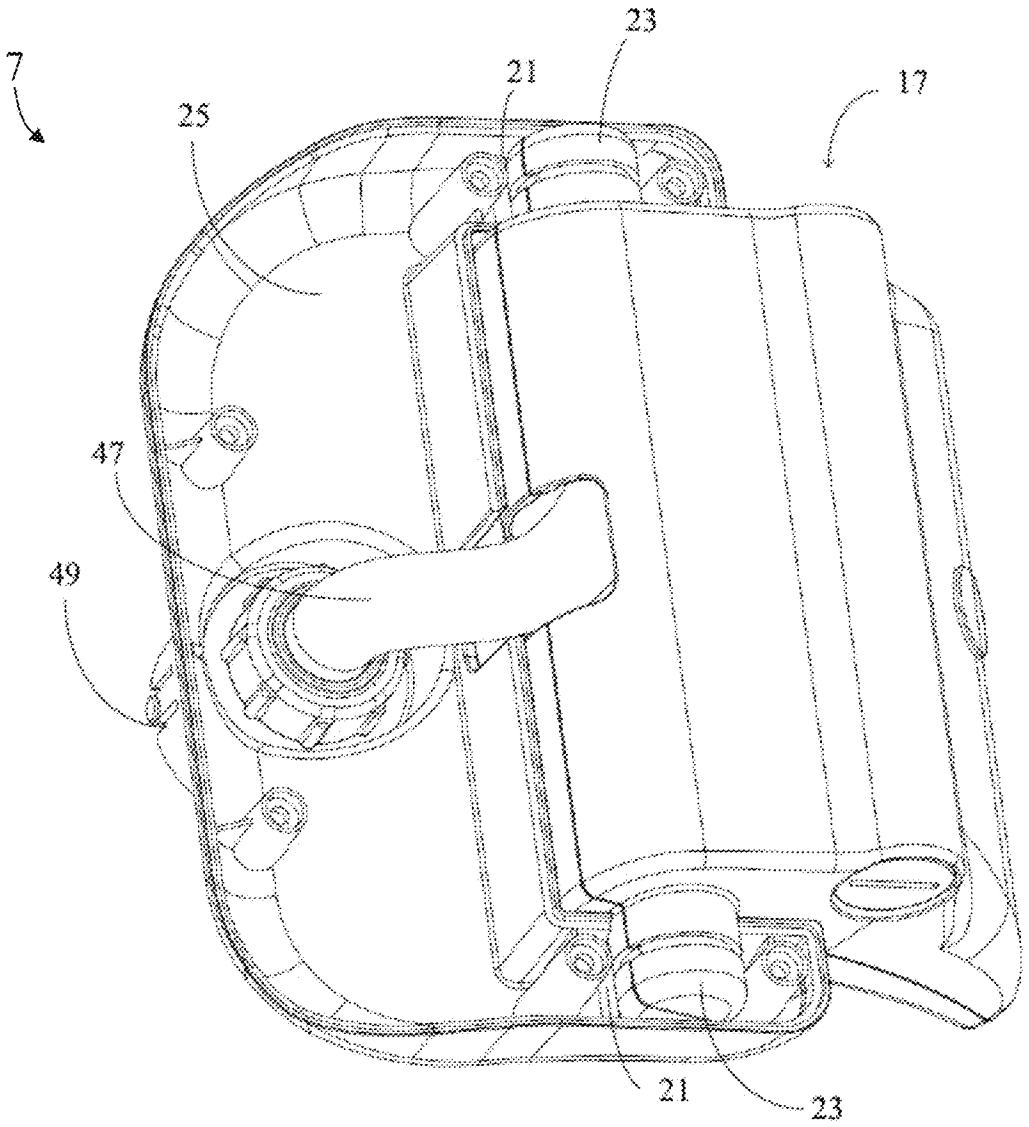
FIG. 8 is a perspective view of the exemplary water spraying device according to some embodiments of the present disclosure, shown without an upper casing.

In some embodiments, and as shown for example in FIG. 8, the first housing 15 includes two support seats 21, and the second housing 17 includes two rotating shafts 23 that are aligned with and respectively supported by the two support seats 21 such that the second housing 17 rotates relative to the first housing 15.

The first housing 15 includes a lower casing 25 joined to an upper casing 27 in a clamshell arrangement. The support seats 21 are located on the lower casing 25. The second housing 17 can be connected to the first housing 15 by the clamshell arrangement of the lower casing 25 and the upper casing 27. First, the rotating shafts 23 of the second housing 17 are mounted on the support seats 21 of the lower casing 25, and then the upper casing 27 is mounted to the lower casing 25, so that the rotating shafts 23 of the second housing 17 extend between the lower casing 25 and the upper casing 27 to facilitate the rotating shafts 23 rotating inside of the support seats 21, so as to enable the second housing 17 to rotate relative to the first housing 15. Moreover, the lower casing 25 and the upper casing 27 are separately formed, which can simplify manufacture and/or assembly when compared with alternative one-piece designs. In some embodiments, the lower casing 25 and the upper casing 27 may be integrated (i.e., the first housing 15 may be a single integrated housing), as long as the first housing 15 can provide the support seats 21 on which the rotating shafts 23 of the second housing 17 rotate.

The second housing 17 comprises a first cover body 29 joined to a second cover body 31 in a clamshell arrangement. The spray head 19 is fixed between the first cover body 29 and the second cover body 31. The spray head 19 can be conveniently provided in the second housing 17 by means of the arrangement of the first cover body 29 and the second cover body 31, and the spray head 19 can be provided between the first cover body 29 and the second cover body 31. For example, the spray head 19 can be fixed within the second housing 17 by first arranging the spray head 19 on one of the first cover body 29 or the second cover body 31 and then connecting the other cover body 29, 31 to the one of the first cover body 29 or the second cover body 31, thus enclosing the spray head 19 between the first cover body 29 and the second cover body 31. It should be understood that the spray head 19 may also be provided in the second housing 17 in another way.

Figure 14:
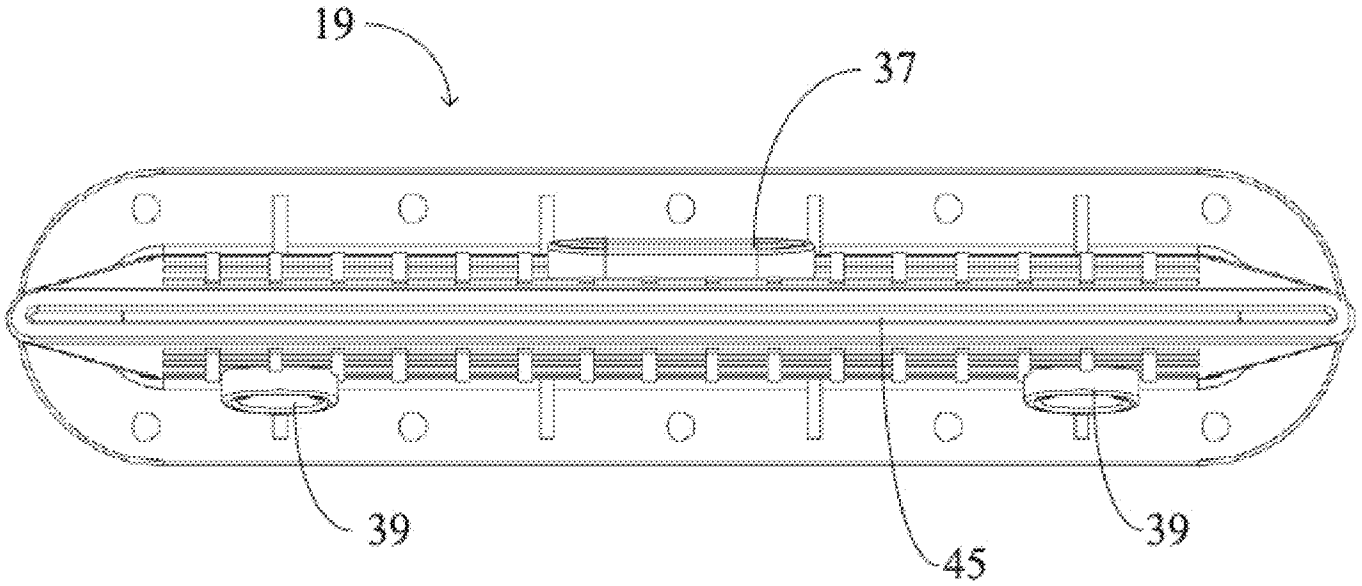
FIG. 14 is a plan view of the spray head of the exemplary water spraying device according to some embodiments of the present disclosure.
Figure 15:
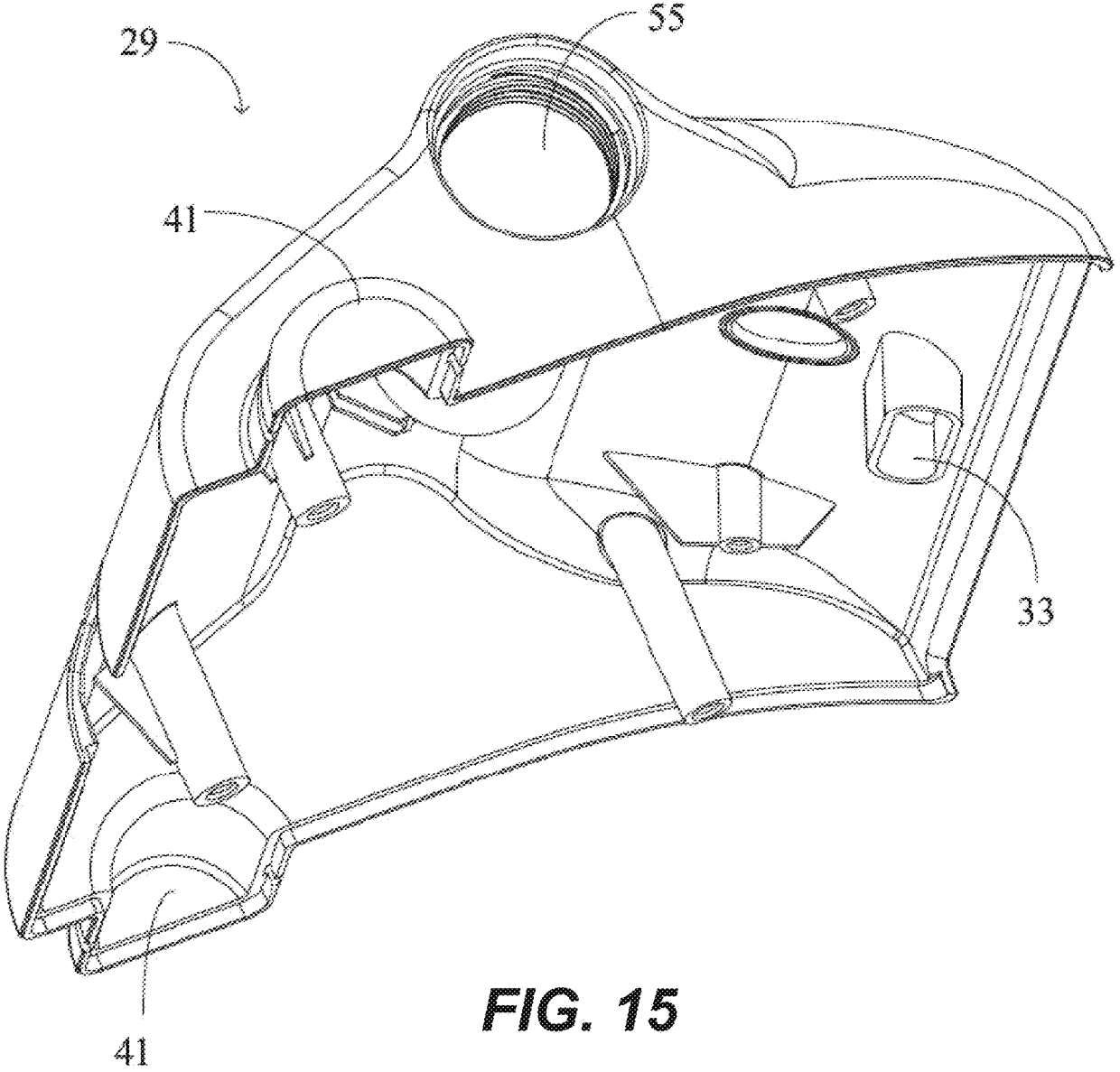
FIG. 15 is a perspective view of the first cover body of the exemplary water spraying device according to some embodiments of the present disclosure.
Figure 16:
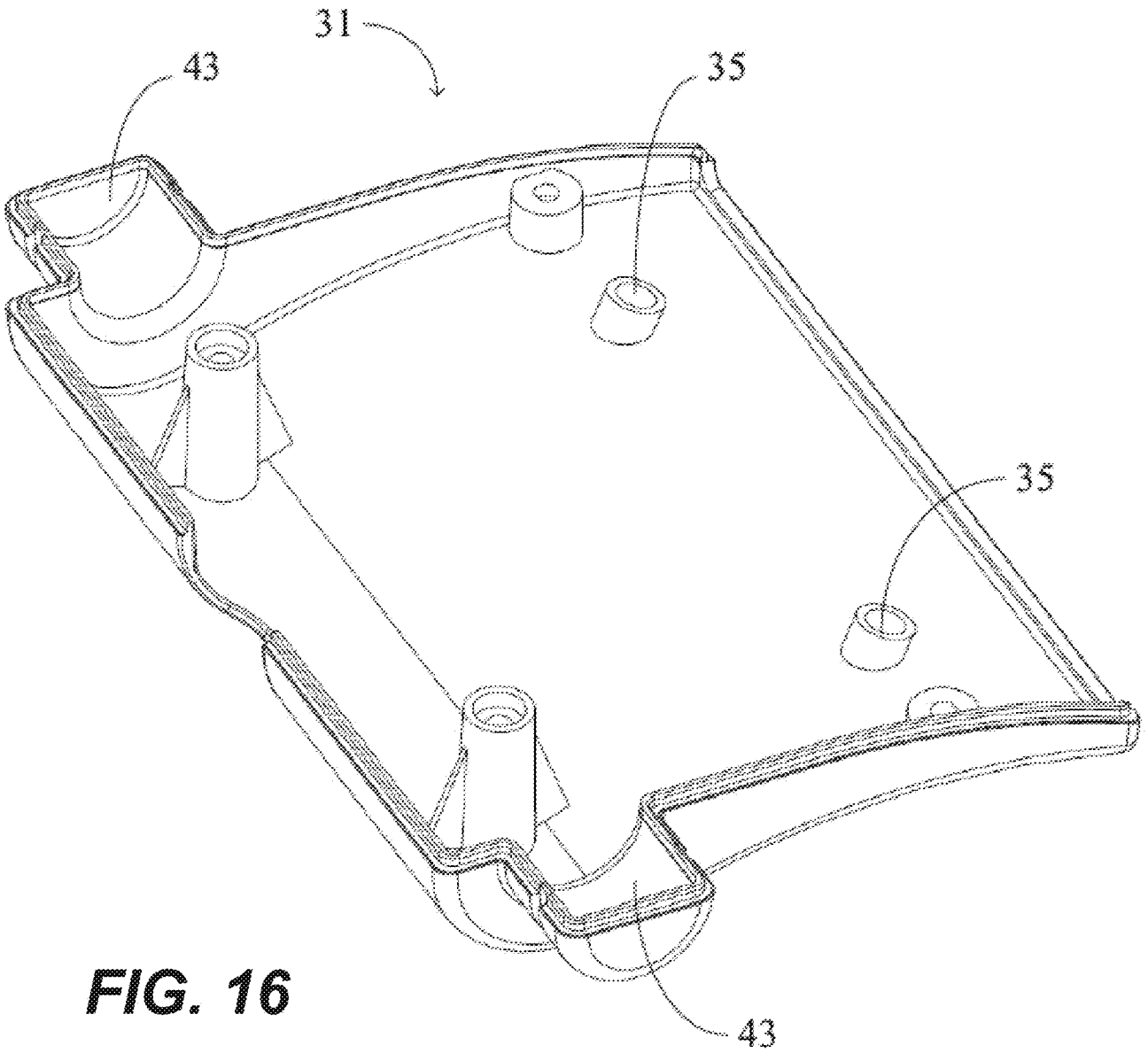
FIG. 16 is a perspective view of a second cover body of the exemplary water spraying device according to some embodiments of the present disclosure.

Referring to FIGS. 14 to 16, the first cover body 29 defines a first protrusion 33, the second cover body 31 defines second protrusions 35, and the spray head 19 defines a first recess 37 and second recesses 39. The first protrusion 33 is configured to fit into the first recess 37, and the second protrusions 35 are configured to fit into the second recesses 39, thereby fixedly connecting the spray head 19 to the first cover body 29 and the second cover body 31. The spray head 19 can be conveniently fixedly connected to the first cover body 29 and the second cover body 31 by means of the cooperation of the protrusions and the recesses, and the spray head 19 can be securely provided between the first cover body 29 and the second cover body 31. Moreover, this connection is detachable, so when maintenance is required, the spray head 19 can be conveniently detached from the first cover body 29 and the second cover body 31. It should be understood that, in some embodiments, it is also possible to provide the cover bodies with recesses and to provide the spray head with protrusions. The exemplary water spraying body 7, as shown in the Figures, includes one first recess 37 and one first protrusion 33, and two of the second recesses 39 and two of the second protrusions 35. However, different numbers of recesses and projections can be employed to securely connect the spray head 19 to the first cover body 29 and the second cover body 31.

Referring to FIGS. 15 and 16, the first cover body 29 includes a first rotating portion 41, and the second cover body 31 includes a second rotating portion 43. The first rotating portion 41 and the second rotating portion 43 are connected to form the rotating shaft 23. The first rotating portion 41 and the second rotating portion 43 each have semicircular shapes, so that the first rotating portion 41 and the second rotating portion 43 together form a circular rotating shaft 23. However, the rotating portions 41, 43, and/or the rotating shaft 23 may have a different configuration. In some embodiments, for example, the rotating shaft 23 may be completely provided only on the first cover body 29 or only on the second cover body 31.

Figure 9:
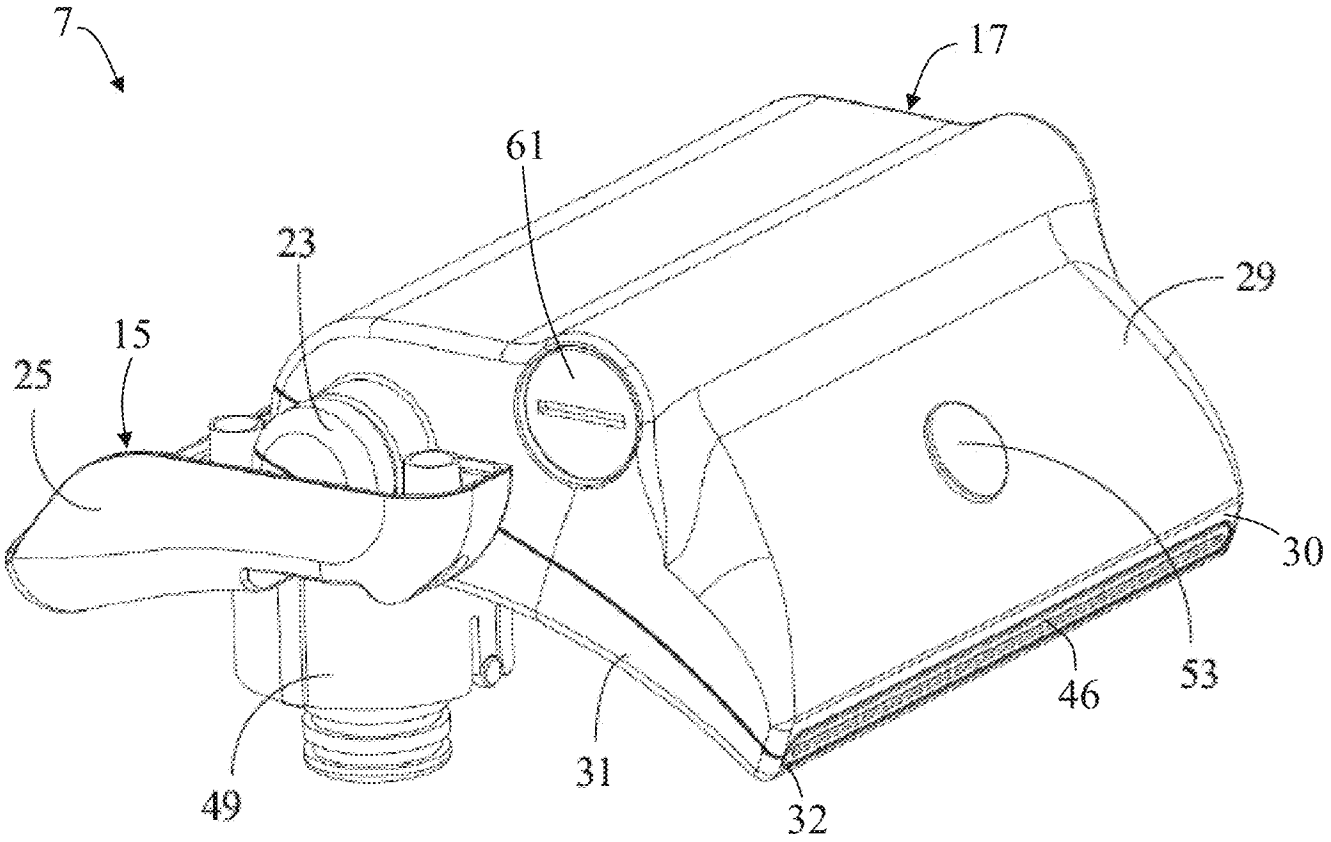
FIG. 9 is another perspective view of the exemplary water spraying device according to some embodiments of the present disclosure, again shown without the upper casing.
Figure 13:
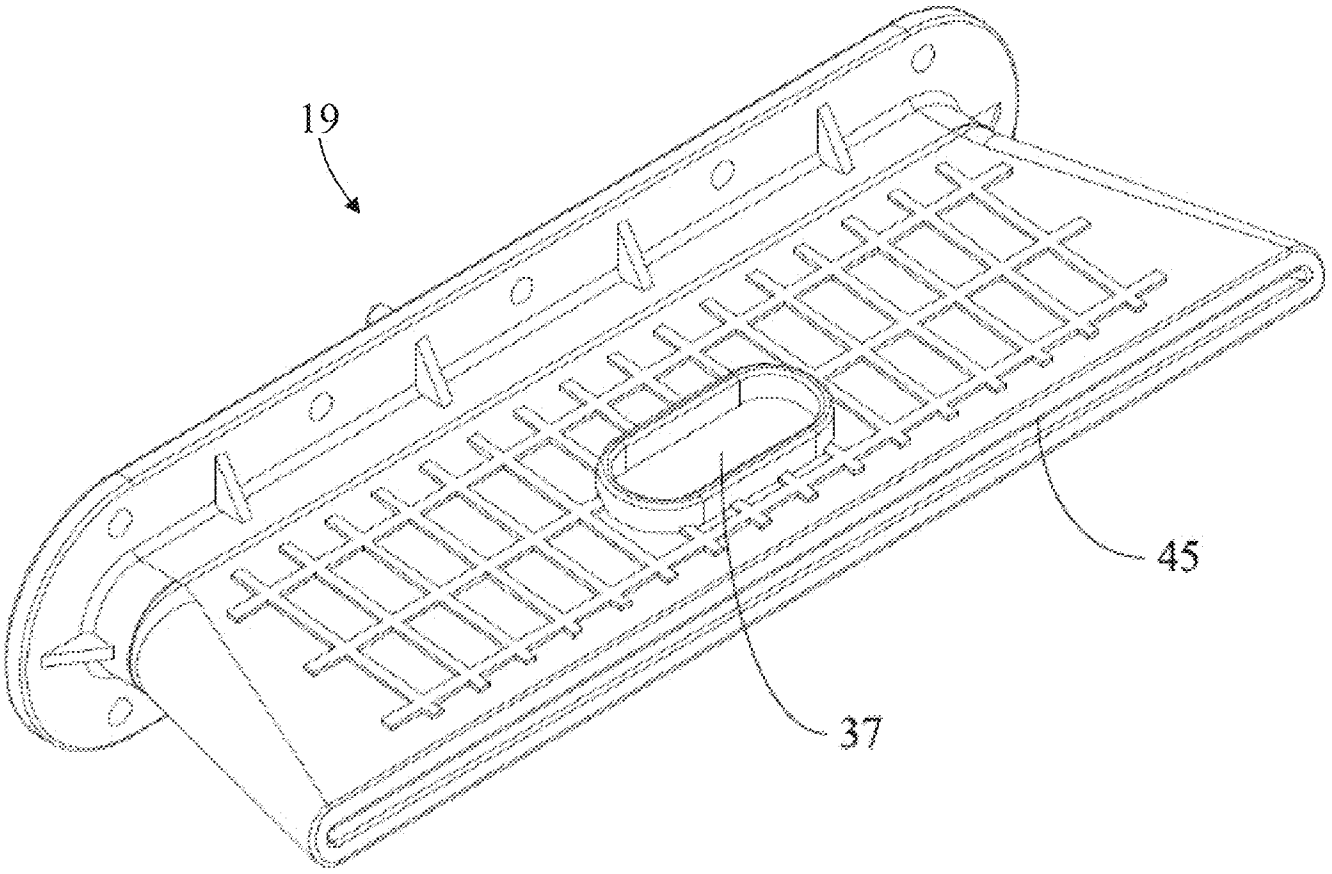
FIG. 13 is a perspective view of a spray head of the exemplary water spraying device according to some embodiments of the present disclosure.

Referring to FIGS. 13 and 14, a water discharge nozzle 45 of the spray head 19 has an elongated shape with a uniform width along a length thereof in order to achieve uniform water discharge and form a waterfall-like water discharge effect. In some embodiments, and as shown in FIG. 9, an end face 46 of the spray head 19, defining the water discharge nozzle 45, is flush with end faces 30, 32 of the first cover body 29 and the second cover body 31, respectively, in a water discharge direction. In this way, it may appear that water directly flows from the second housing 17.

Figure 10:
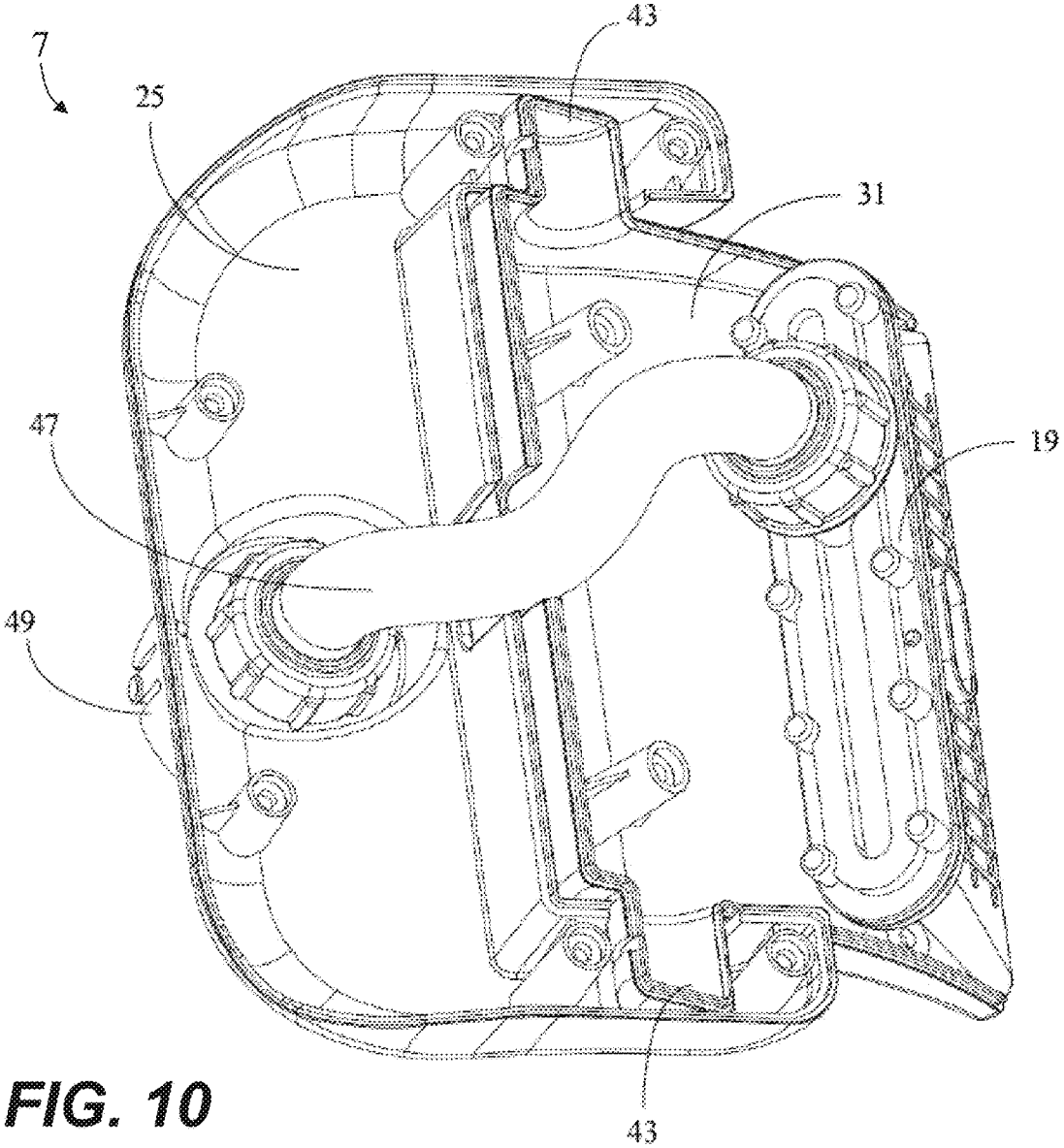
FIG. 10 is a perspective view of the exemplary water spraying device according to some embodiments of the present disclosure, again shown without the upper casing and shown without a first cover body.
Figure 11:
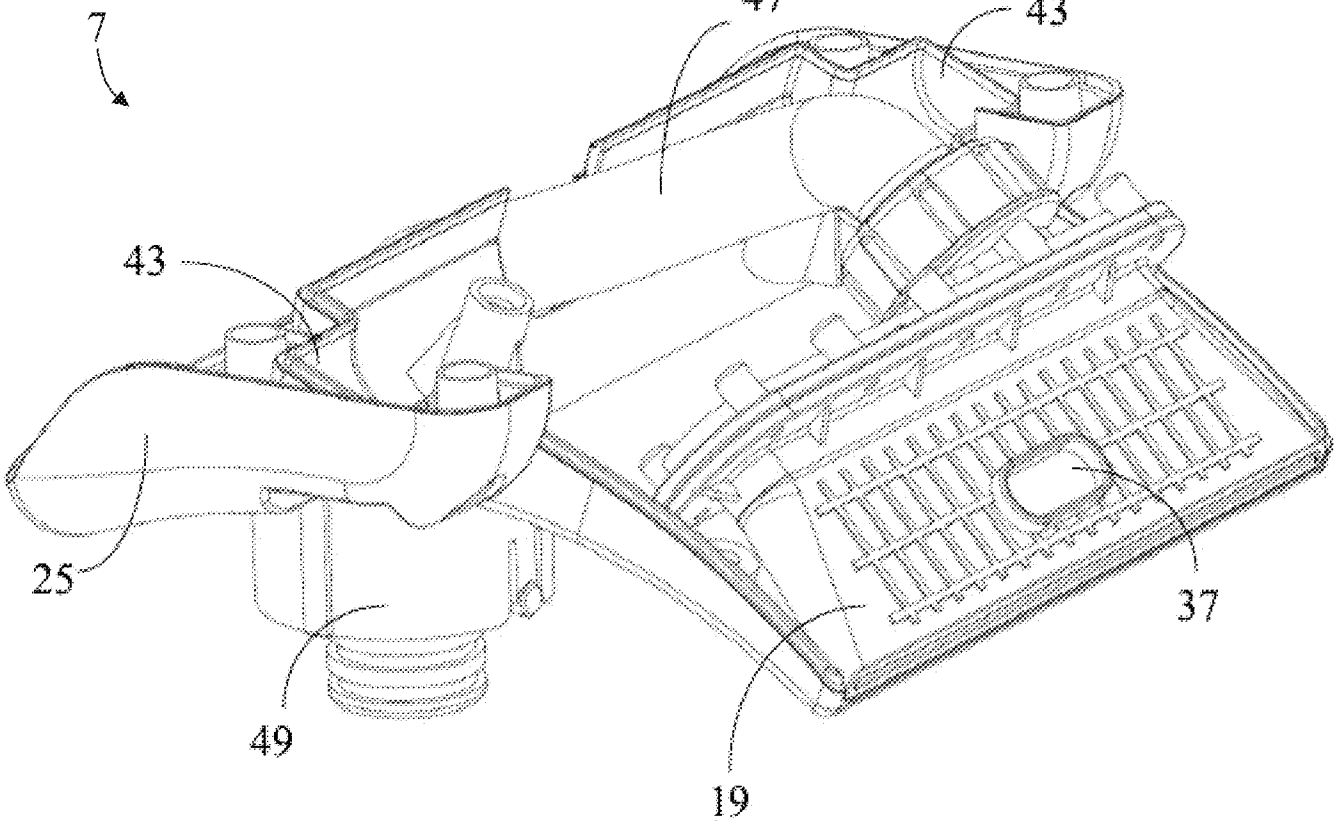
FIG. 11 is another perspective view of the exemplary water spraying device according to some embodiments of the present disclosure, again shown without the upper casing and without the first cover body.
Figure 12:
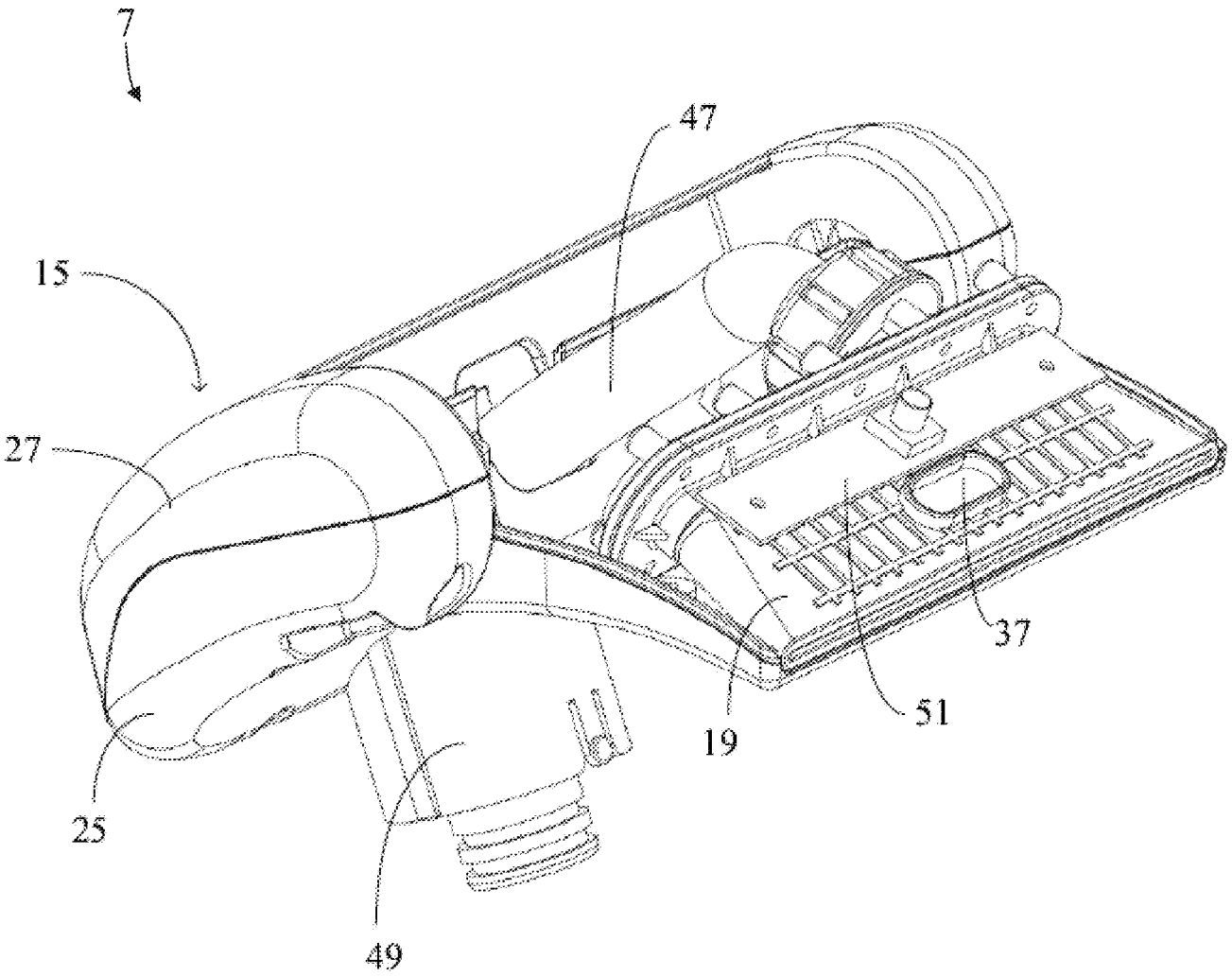
FIG. 12 is a perspective view of the exemplary water spraying device according to some embodiments of the present disclosure, again shown without the first cover body.

In some embodiments, the water spraying body 7 includes a hollow flexible pipe 47 for conveying water to the spray head 19. Water flow from the water pump 13 enters the water spraying body 7 via the water pipe 11 and the base 9 and enters the spray head 19 via the hollow flexible pipe 47. Referring to FIGS. 10 to 12, in the illustrated embodiment, one end of the hollow flexible pipe 47 is connected to the spray head 19 in the second housing 17, and the other end thereof is connected to the lower casing 25. The arrangement of the hollow flexible pipe 47 can avoid obstructing the rotation of the second housing 17 relative to the first housing 15. The lower casing 25 may be further provided with a connector 49, with one end of the connector 49 being connected to the other end of the hollow flexible pipe 47, and the other end of the connector 49 being connected (e.g., screwed) to the base 9. In this way, the water spraying body 7 can be conveniently mounted to the base 9 or detached from the base 9, saving on time and labor for replacement, maintenance and other operations.

Referring to FIG. 12, the water spraying body 7 includes a light source module 51, located on at a top face of the spray head 19. The light source module 51 may illuminate the water being discharged by the spray head 19 and thereby produce a luminous effect. For example, the light source module 51 may be an LED light source module. In some embodiments, light source module 51 may include one or more LED devices capable of generating different colors to implement multiple color conversions.

Referring back to FIG. 9, a switch button 53 is located on the first cover body 29. The switch button 53 is coupled to the light source module 51 to control activation and deactivation of the light source module 51. For example, by pressing the switch button 53, the light source module 51 can be turned on or off.

Figure 7:
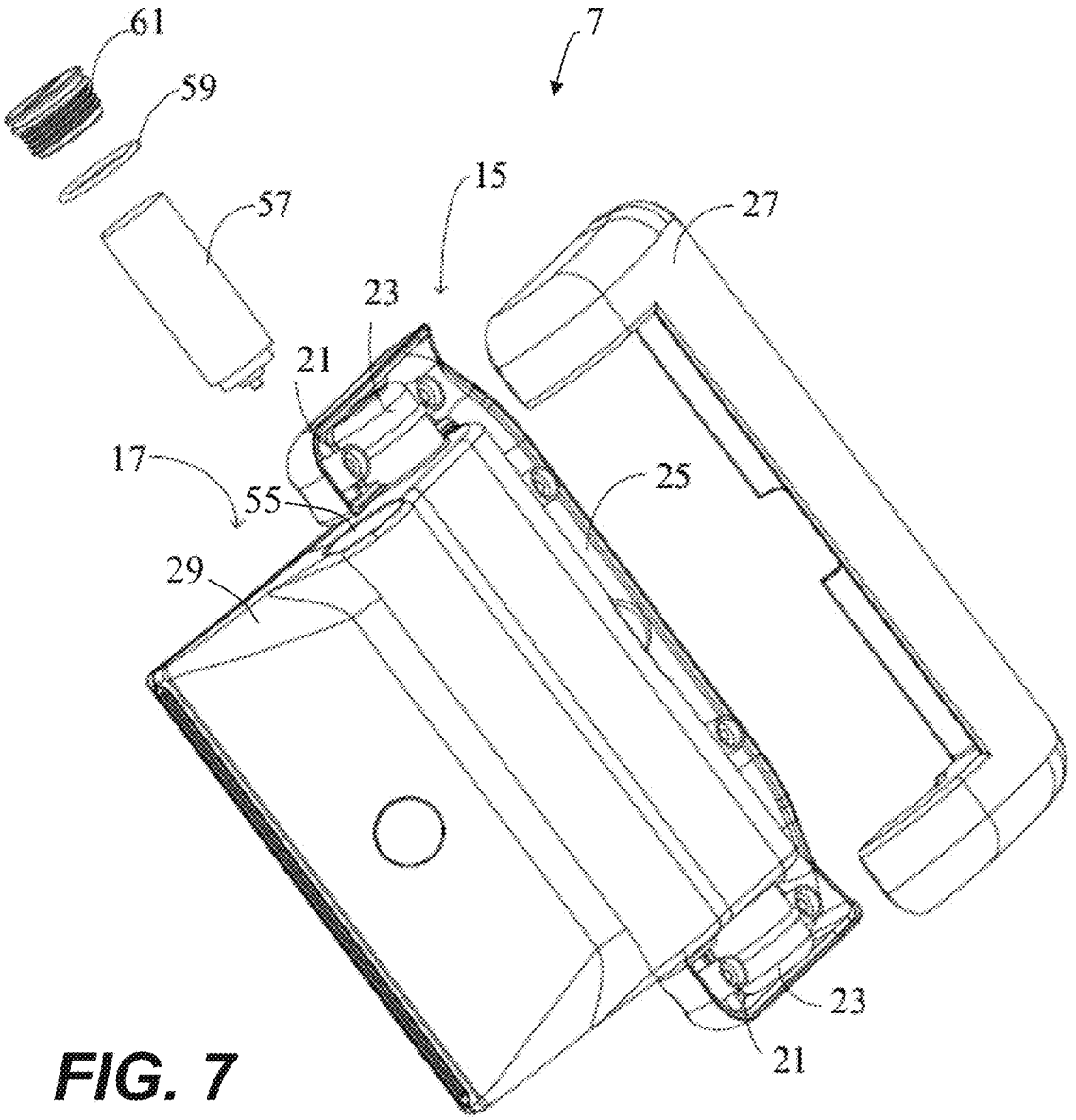
FIG. 7 is a partial exploded view of the exemplary water spraying device according to some embodiments of the present disclosure.

Referring to FIG. 15, the first cover body 29 defines a power supply chamber 55 configured to hold a power supply 57 therein. Referring to FIG. 7, the power supply 57 may be provided inside the power supply chamber 55 of the first cover body 29. The power supply chamber 55 may be enclosed with a watertight seal by a seal ring 59 and a seal cap 61. The power supply 57 is electrically connected to the light source module 51 to supply power thereto. The power supply 57 may be a dry battery, a lithium battery or a rechargeable battery. Alternatively or additionally, the light source module 51 may be powered by an external power supply (not shown).

Figure 17:
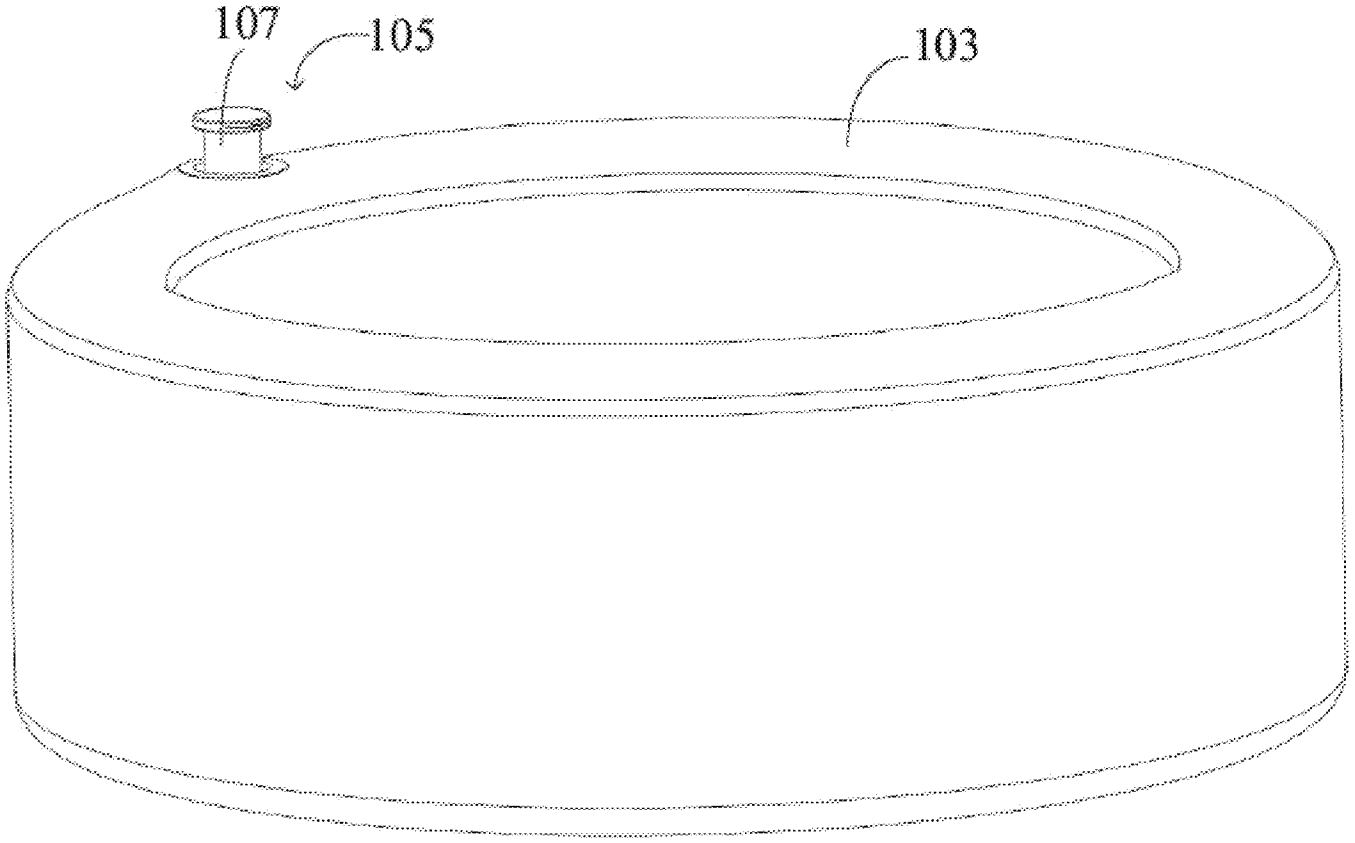
FIG. 17 is a perspective view of a pool according to some embodiments of the present disclosure, with an exemplary water spraying body in an open position.
Figure 18:
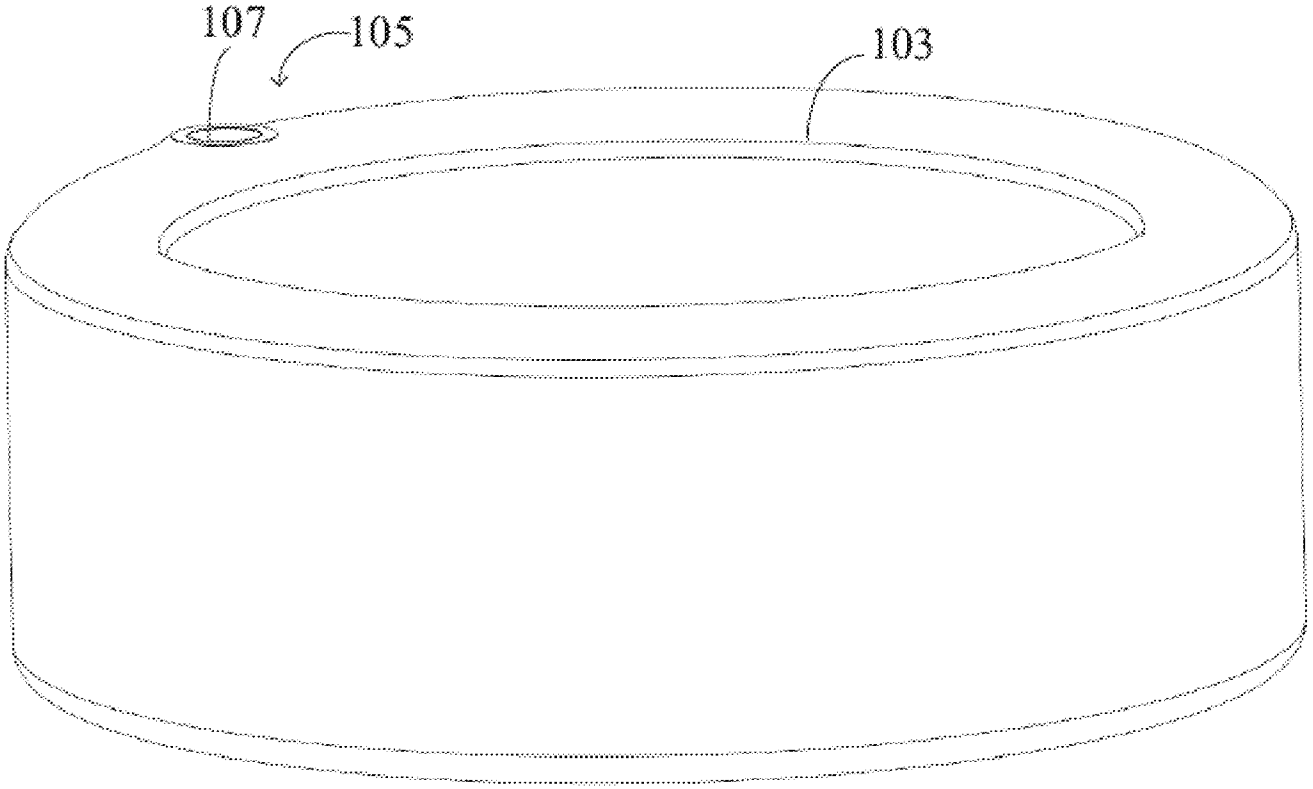
FIG. 18 is a perspective view of the pool according to some embodiments of the present disclosure, with the exemplary water spraying body in a closed position.
Figure 19:
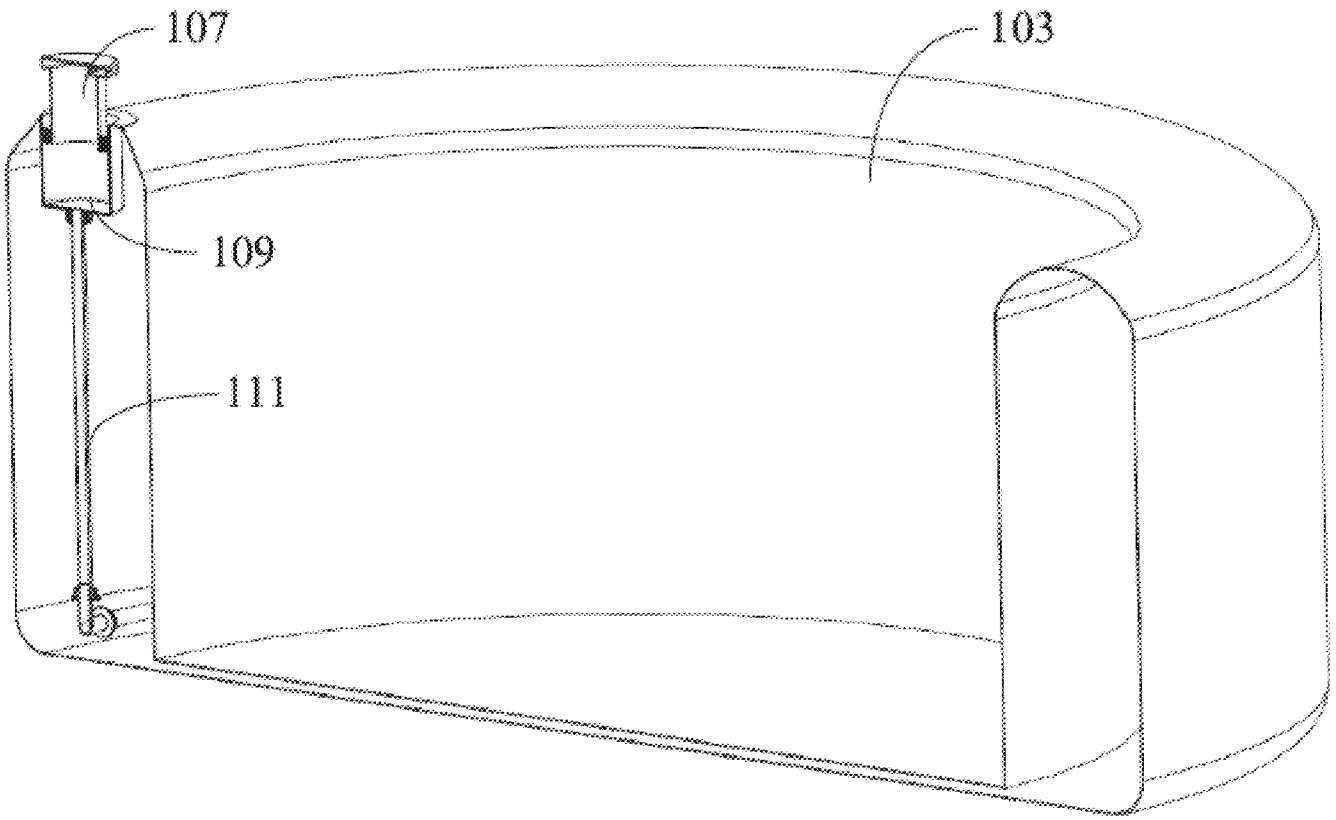
FIG. 19 is a cross-sectional view of the pool according to some embodiments of the present disclosure.

FIGS. 17 to 19 show various views of a pool according to other embodiments of the present disclosure. The pool comprises a pool body 103 and a water spraying device 105 mounted to the pool body 103. In some embodiments, and as shown in FIGS. 17 to 19, the pool body 103 takes the form of an inflatable pool body, and the pool body 103 has a circular shape. However, the water spraying device 105 of the present disclosure may be used with any type of pool and with any shape of pool. The water spraying device 105 comprises a water spraying body 107, a base 109, a water pipe 111 and a water pump (not shown). The base 109 is configured to be fixed to the pool above a water level in the pool for discharging water into the pool.

Figure 20:
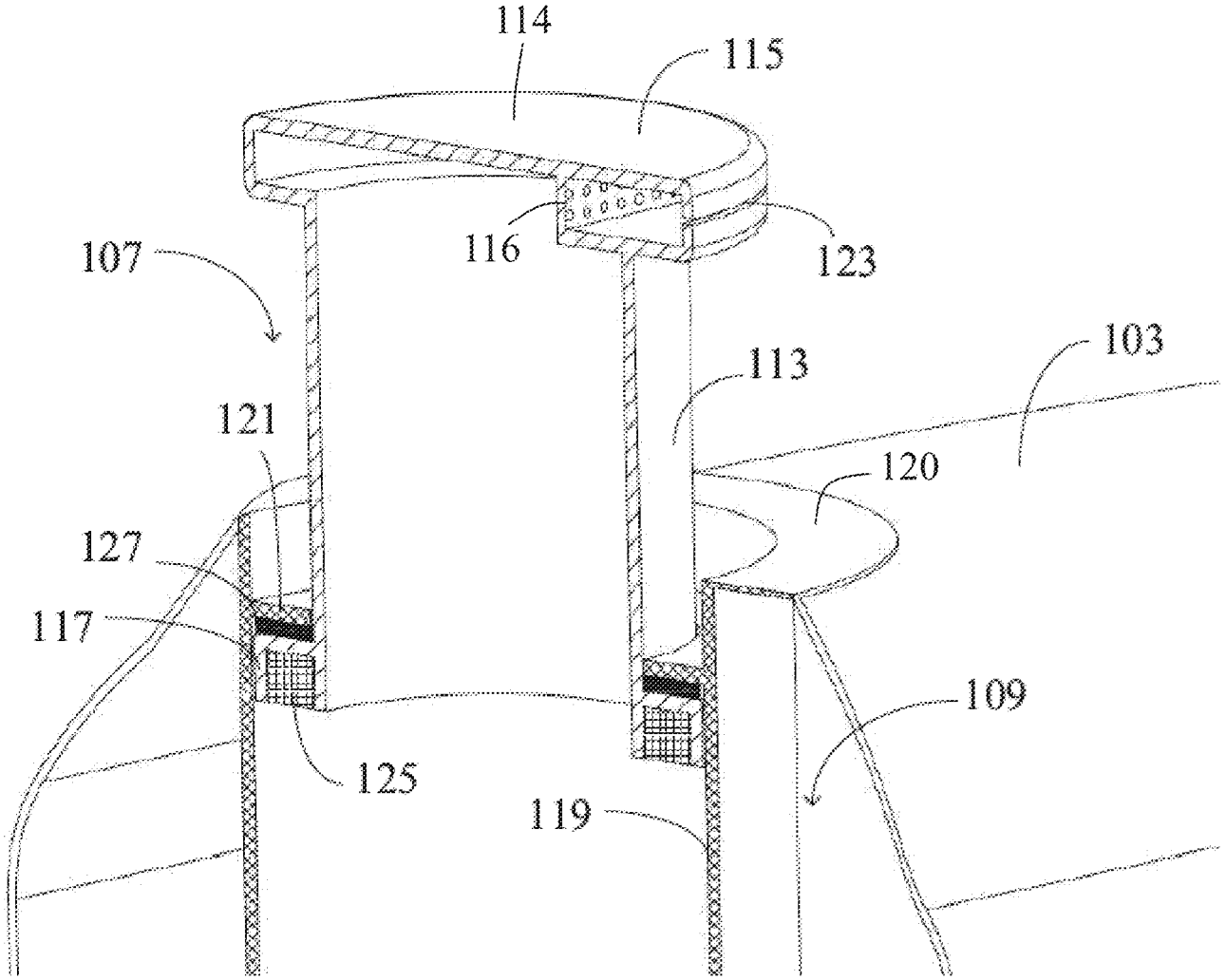
FIG. 20 is a cross-sectional view of an exemplary water spraying device according to some embodiments of the present disclosure.

As shown in FIGS. 17 and 18, the water spraying body 107 is located at the top of a side wall of a pool body 103. The water spraying body 107 is respectively shown in an open position (FIG. 17) and in a closed position (FIG. 18). As shown in FIG. 19, the water pipe 111 is located inside of an inflatable chamber of the side wall of the pool body 103, with one end of the water pipe 111 being connected to the water pump (not shown), and the other end of the water pipe 111 being connected to the base 109. Referring to FIG. 20, the base 109 is mounted at the top of the side wall of the pool body 103, and the water spraying body 107 is mounted inside of the base 109. A top face of the side wall 119 of the base 109 is flush with the top of the side wall of the pool body 103. The two can be connected by means of high-frequency welding. In operation, the water pump moves water contained by the pool body 103 into the water pipe 111, and the water enters the water spraying body 107 via the water pipe 111 and the base 109 and then is sprayed from the water spraying body 107 into the pool body 103, thereby forming a water circulation loop. Of course, the water spraying device 105 may also supply water in other ways and same is sprayed into the pool body 3 by the water spraying body 107.

Figure 21:
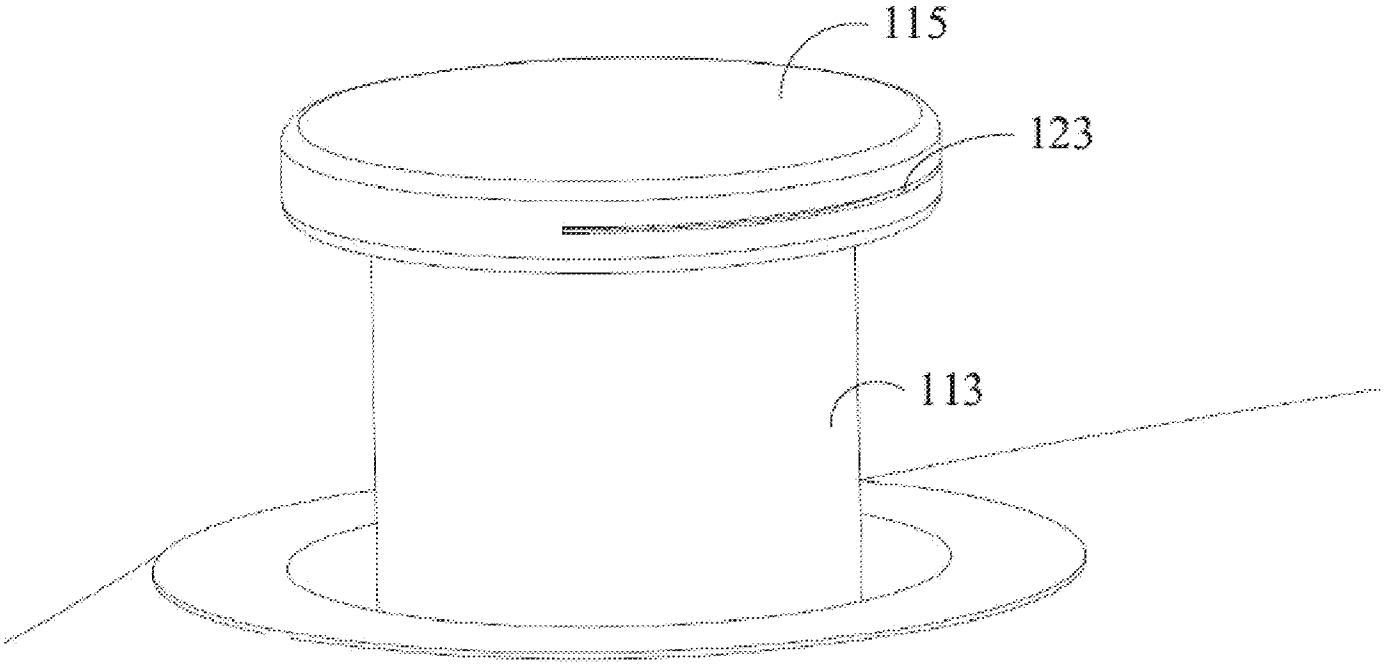
FIG. 21 is a perspective view of the exemplary water spraying body according to some embodiments of the present disclosure.

FIGS. 20 and 21 show the water spraying device 105 according to other embodiments of the present disclosure. As shown, the base 109 includes a side wall 119 having a cylindrical shape, with a baffle 121 located on an inner surface of the side wall 119 and extending circumferentially therefrom. The water spraying body 107 includes a casing 113 and a spray head 115 located at a top of the casing 113. The spray head 115 is configured to discharge water into the pool body 103. The water spraying body 107 also includes an abutment portion 117 extending circumferentially around a bottom of the casing 113.

In some embodiments, and as shown in FIGS. 17 to 21, the casing 113 has a cylindrical shape. However, the casing 113 may have a different shape. In some embodiments, and as shown in the FIGS. 17 and 19-21, the spray head 115 has a disc shape with a diameter that is greater than a diameter of the casing 113.

When the water spraying body 107 is in the open position, the abutment portion 117 of the water spraying body 107 abuts against the bottom face of the baffle 121. When the water spraying body 107 is in the closed position, the water spraying body 107 can be supported at the bottom of the base 109 such that the top face of the spray head 115 is flush with the top face of the side wall 119 of the base 109. Since the top face of the side wall 119 of the base 109 is flush with the top face of the side wall of the pool body 103, the top face of the spray head 115 can be flush with the top face of the side wall of the pool body 103, which not only produces a good visual effect, but also does not cause an obstacle against a user entering and exiting the pool body 103. In some embodiments, when the water spraying body 107 is in the closed position, the spray head 115 can be supported at the baffle 121 of the base 109 such that the top face of the spray head 115 is flush with the top face of the side wall 119 of the base 109.

In some embodiments, a water discharge nozzle 123 of the spray head 115 has an elongated shape and a uniform width along a length thereof in order to provide a uniform water discharge forming a waterfall-like water discharge effect.

In some embodiments, and as shown in FIG. 20, the spray head 115 includes a restrictor plate 116 defining a plurality of holes for controlling a flow of water to the water discharge nozzle 123. The restrictor plate 116 may provide a more uniform water flow across the water discharge nozzle 123.

In some embodiments, and as also shown in FIG. 20, the spray head 115 includes a top face 114, and the base 109 includes a top face 120, which may extend radially outwardly from the side wall 119. The top face 114 of the spray head 115 may be flush with the top face 120 of the base 109 when the water spraying body 107 is in a recessed (or lowered or closed position).

The abutment portion 117 of the spray head 115 has an inverted cup shape for accommodating a floating material 125 having a buoyancy greater than water. In other words, the floating material 125 can float in water. The floating material 125 may include, for example, a foam material. Water entering the base 109 via the water pipe 111 may cause the water spraying body 107 to move upward as a result of the buoyancy of the floating material until the abutment portion 117 of the water spraying body 107 abuts against the bottom face of the baffle 121, and the water spraying body 107 is suspended in reaching the open position. Water then flows through the casing 113 of the water spraying body 107 and into the the spray head 115; the water then flows out of the water discharge nozzle 123 of the spray head 115 into the pool body 103. When the base 109 is not filled with water, the water spraying body 107 may return to the recessed (or lowered or closed position), with the top face 114 of the spray head 115 flush with the top face 120 of the base 109.

In some embodiments, and as shown in FIG. 20, a sealing gasket 127 is disposed on the bottom face of the baffle 121 to prevent water from flowing out via a gap between the casing 113 of the water spraying body 107 and the baffle 121 of the base 109. The sealing gasket 127 may have an annular shape. In addition to the sealing effect, the sealing gasket 127 can also provide a cushioning effect between the baffle 121 of the base 109 and impact from the abutment portion 117 of the water spraying body 107.

The water spraying device provided in the present disclosure can adjust the angle of water discharge, is easy to use, can be conveniently mounted and detached, and saves on time and labor for replacement, maintenance and other operations. A waterfall or water spraying feature provided by the water spraying device also improves the entertainment experience of the pool.

Although some embodiments have been described by way of examples herein, various variations could be made to these embodiments without departing from the spirit of the present disclosure. All such variations belong to the conception of the present disclosure and fall within the scope of protection defined by the claims of the present disclosure. The specific embodiments disclosed herein are merely illustrative of the present disclosure. It would be apparent to those skilled in the art that various modifications could be made according to the teachings of the present disclosure, and the present disclosure could be practiced in various equivalent ways. Thus, the particular embodiments of the present invention as disclosed herein are illustrative only, and the scope of protection of the present disclosure is not limited by the details of the structures or designs disclosed herein. Accordingly, various substitutions, combinations, or modifications could be made to the particular exemplary embodiments disclosed herein, and all variations thereof fall within the scope of the present disclosure.

What is claimed is:

1. A water spraying device for a pool, comprising:

a water spraying body configured to be fixed to the pool above a water level in the pool, wherein the water spraying body includes:

a first housing with a support seat disposed inside the first housing;

a second housing including a rotating shaft supported by the support seat such that the second housing is rotatable relative to the first housing; and a spray head located in the second housing and configured to discharge water into the pool;

wherein the second housing comprises a first cover body joined to a second cover body in a clamshell arrangement, wherein the spray head is fixed between the first cover body and the second cover body.

2. The water spraying device of claim 1, wherein the first housing comprises a lower casing joined to an upper casing in a clamshell arrangement, wherein the support seat is located on the lower casing.

3. The water spraying device of claim 1, wherein the first cover body includes a first rotating portion, and the second cover body includes a second rotating portion, wherein the first rotating portion is connected to the second rotating portion to form the rotating shaft.

4. The water spraying device of claim 1, wherein the spray head comprises a water discharge nozzle having an elongated shape with a uniform width along a length thereof.

5. The water spraying device of claim 4, further comprising an end face of the spray head defining the water discharge nozzle, wherein the end face of the spray head is flush with end faces of the first cover body and the second cover body in a water discharge direction.

6. The water spraying device of claim 1, further comprising a light source module located on a top face of the spray head.

7. The water spraying device of claim 6, further comprising a switch button located on the first cover body, wherein the switch button is coupled to the light source module to control activation and deactivation of the light source module.

8. The water spraying device of claim 1, wherein the first cover body defines a first protrusion, the second cover body defines a second protrusion, and the spray head defines a first recess and a second recess, wherein the first protrusion is configured to fit in the first recess, and the second protrusion is configured to fit in the second recess, thereby fixedly connecting the spray head to the first cover body and the second cover body.

9. The water spraying device of claim 1, wherein the water spraying body comprises a hollow flexible pipe, with one end of the hollow flexible pipe being connected to the spray head in the second housing, and the other end of the hollow flexible pipe being connected to the lower casing.

10. The water spraying device of claim 9, wherein the lower casing is further provided with a connector, with one end of the connector being connected to the other end of the hollow flexible pipe, and the other end of the connector being adapted for mounting the water spraying body.

11. The water spraying device of claim 1, wherein the first cover body defines a power supply chamber configured to hold a power supply therein.

12. The water spraying device of claim 1, further comprising a base, a water pipe and a water pump, wherein the water spraying body is connected to the base, and the base is connected to the water pump via the water pipe.

13. A pool comprising the water spraying device of claim 1.

14. A water spraying device for a pool, comprising:

a base configured to be fixed to the pool above a water level in the pool, the base including a side wall having a cylindrical shape with a baffle located on an inner surface of the side wall and extending circumferentially therefrom; and a water spraying body including a casing and a spray head located at a top of the casing and configured to discharge water into the pool, the water spraying body having an abutment portion extending circumferentially around a bottom of the casing, wherein the abutment portion is adapted to abut against a bottom face of the baffle;

wherein the spray head has a disc shape and comprises:

a water discharge nozzle with an elongated shape and a uniform width along a length thereof; and a restrictor plate defining a plurality of holes for controlling a flow of water to the water discharge nozzle.

15. The water spraying device of claim 14, wherein the spray head includes a top face configured to be flush with a top face of the base when the water spraying body is in a recessed position.

16. A water spraying device for a pool, comprising:

a base configured to be fixed to the pool above a water level in the pool, the base including a side wall having a cylindrical shape with a baffle located on an inner surface of the side wall and extending circumferentially therefrom;

a water spraying body including a casing and a spray head located at a top of the casing and configured to discharge water into the pool, the water spraying body having an abutment portion extending circumferentially around a bottom of the casing, wherein the abutment portion is adapted to abut against a bottom face of the baffle; and a sealing gasket disposed upon the bottom face of the baffle, wherein the abutment portion of the water spraying body forms a region for receiving a floating material.

17. The water spraying device of claim 14, further comprising a water pipe and a water pump, wherein the base is connected to the water pump via the water pipe.

18. A pool comprising the water spraying device of claim 14.

* * * * *